US006907217B2

(12) United States Patent
Hattori

(10) Patent No.: US 6,907,217 B2
(45) Date of Patent: Jun. 14, 2005

(54) IMAGE FORMING DEVICE CAPABLE OF SUPPRESSING DISTORTION IN OUTPUT IMAGE

(75) Inventor: Tomoaki Hattori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/327,903

(22) Filed: Dec. 26, 2002

(65) Prior Publication Data

US 2003/0118379 A1 Jun. 26, 2003

(30) Foreign Application Priority Data

Dec. 25, 2001 (JP) ..... 2001-391745

(51) Int. Cl.[7] ..... G03G 15/16; G03G 21/00
(52) U.S. Cl. ..... 399/297; 399/345
(58) Field of Search ..... 399/297–299, 399/301, 302, 343–345

(56) References Cited

U.S. PATENT DOCUMENTS 5,828,926 A 10/1998 Iwata et al.

FOREIGN PATENT DOCUMENTS

| | | |
|---|---|---|
| JP | 8-006350 | 1/1996 |
| JP | A 9-62120 | 3/1997 |
| JP | 9-90779 | 4/1997 |
| JP | A 10-48967 | 2/1998 |
| JP | 10-232532 | 9/1998 |
| JP | 11-007202 | 1/1999 |
| JP | 11-065306 | 3/1999 |
| JP | 2000-0330358 | 11/2000 |

*Primary Examiner*—Hoang Ngo
(74) *Attorney, Agent, or Firm*—Oliff & Berridge, PLC

(57) ABSTRACT

A latent image formed on a photosensitive member in exposure operations is developed into a toner image, which is then transferred onto an image bearing member in primary transfer operations. Afterward, the toner image is transferred onto a recording sheet in secondary transfer operations. A cleaning unit for cleaning the image bearing member by removing residual toner therefrom is brought into and out of contact with the surface of the image bearing member at a time when neither the exposure operations nor primary transfer operations are being performed.

17 Claims, 8 Drawing Sheets

IMAGE FORMING DEVICE CAPABLE OF SUPPRESSING DISTORTION IN OUTPUT IMAGE

BACKGROUND OF THE INVENTION

1. Field of the Invention

The present invention relates to an image forming device for forming images on a recording medium using a developing agent.

2. Description of the Related Art

A laser printer is an example of a well-known image forming device for printing images on a recording medium. In such a laser printer, a laser device radiates a laser beam, based on image data, onto a photosensitive member to form electrostatic latent images thereon. Selectively transferring toner, which is a developing agent in powdered form, onto the photosensitive member develops the electrostatic latent images into visible toner images, which are then transferred onto a paper sheet or other recording medium.

Laser printers capable of forming color images are also well known. Such laser printers store different colors of toner, such as cyan (C), magenta (M), yellow (Y), and black (BK) toner. Electrostatic latent images are formed one after the other on the photosensitive member for each color, and then developed into visible toner images using toner in the corresponding colors. The toner images are transferred one after the other in a primary transfer operation onto an intermediate transfer member so that the different colored toner images overlap one on the other. As a result, a multicolor toner image is formed on the intermediate transfer member by the overlapping monochrome images. Afterward, the multicolor toner image is transferred onto the recording medium in a secondary transfer operation, to form a color image on the recording medium.

However, not all of the toner that forms the multicolor toner image is transferred from the intermediate transfer member to the recording medium. Therefore, a cleaning unit is normally provided to clean the intermediate transfer member by removing the residual toner that clings to the intermediate transfer member after the secondary transfer.

The cleaning unit can be switched between a non-cleaning mode, wherein the cleaning unit cannot remove toner from the intermediate transfer member, and a cleaning mode, wherein the cleaning unit can remove toner from the intermediate transfer member. By switching the mode of the cleaning unit at appropriate timings, residual toner alone can be selectively removed from the intermediate transfer member without damaging the multicolor toner image. Normally, the cleaning unit is in contact with the intermediate transfer member in the cleaning mode and separated from the intermediate transfer member in the non-cleaning mode.

When the cleaning unit is switched between these modes, vibration is generated in the laser printer and also the load on the rotating intermediate transfer member can fluctuate. These can warp or distort the image being output.

For example, when the cleaning unit is brought into or out of contact with the intermediate transfer member during the primary transfer, the intermediate transfer member vibrates due to the action of contact or separation. Further, the fluctuation in the load on the rotating intermediate transfer member produces temporary fluctuations in rotation speed. Therefore, the toner image that is in the process of being transferred in the primary transfer process can be distorted because of the mode switching operation of the cleaning unit. Accordingly, the corresponding portion of the image outputted after the secondary transfer will be distorted. There is also a problem particular to color laser printers because the different colored toner images are stacked one on top of the other on the intermediate transfer member. That is, the overlap between different colored toner images can be shifted when the rotational speed of the intermediate transfer member changes, resulting in distortion in the colors of the output image.

Japanese Patent-Application Publication (Kokai) No. HEI-10-48967 discloses an image forming device that does not perform the mode-switching operation of the cleaning unit during the primary transfer operation. Accordingly, distortion in the output image that results from generation of vibration in the image forming device and fluctuations of the rotation load during primary transfer that can be caused by contact and separation of the cleaning unit can be suppressed to a certain extend.

However, in the image forming devices such as laser printers that form images by forming an electrostatic latent image and performing a primary transfer and a secondary transfer, it is not possible to sufficiently suppress distortion in the output image by merely controlling the contact and separation operations of the cleaning unit by taking the primary transfer into consideration.

It is an objective of the present invention to provide an image forming device capable of suppressing distortion and shifts in outputted images due to the contact and separation operations of a cleaning unit.

In order to achieve the above and other objects, according to the present invention, there is provided an image forming device including an endless photosensitive member, an exposure unit, a developing unit, an endless image bearing member, a secondary transfer unit, a cleaning unit, and a control unit. The endless photosensitive member moves in a first direction. The exposure unit performs exposure operations for exposing the photosensitive member at an exposure position to form a latent image on the photosensitive member. The developing unit develops the latent image into a developing-agent image on the photosensitive member at a developing position that is downstream from the exposure position in the first direction. The endless image bearing member contacts the photosensitive member at a primary transfer position that is downstream from the developing position in the first direction. The image bearing member moves in a second direction. The developing-agent image is transferred from the photosensitive member onto the image bearing member at the primary transfer position in primary transfer operations. The secondary transfer unit performs secondary transfer operations for transferring the developing-agent image from the image bearing member onto a recording medium at a secondary transfer position that is downstream from the primary transfer position in the second direction. The cleaning unit is switched between a contact condition where the cleaning unit is in contact with the image bearing member at a cleaning position and a separation condition where the cleaning unit is separated from the image bearing member. The cleaning position is downstream from the secondary transfer position and upstream from the primary transfer position in the second direction. The cleaning unit in the contact condition removes residual developing agent from the image bearing member after the secondary transfer operations. The control unit switches the cleaning unit between the contact condition and the separation condition during a stopped period wherein no latent image is being formed during the exposure operations.

BRIEF DESCRIPTION OF THE DRAWINGS

In the drawings:

FIG. 7 (*b*) is a block diagram showing essential components of the modification of FIG. 7(*a*);

DETAILED DESCRIPTION OF THE EMBODIMENTS

Next, color laser printers will be described according to embodiments of the present invention with reference to the attached drawings.

First, a color laser printer 1 according to a first embodiment will be explained.

Figure 1:
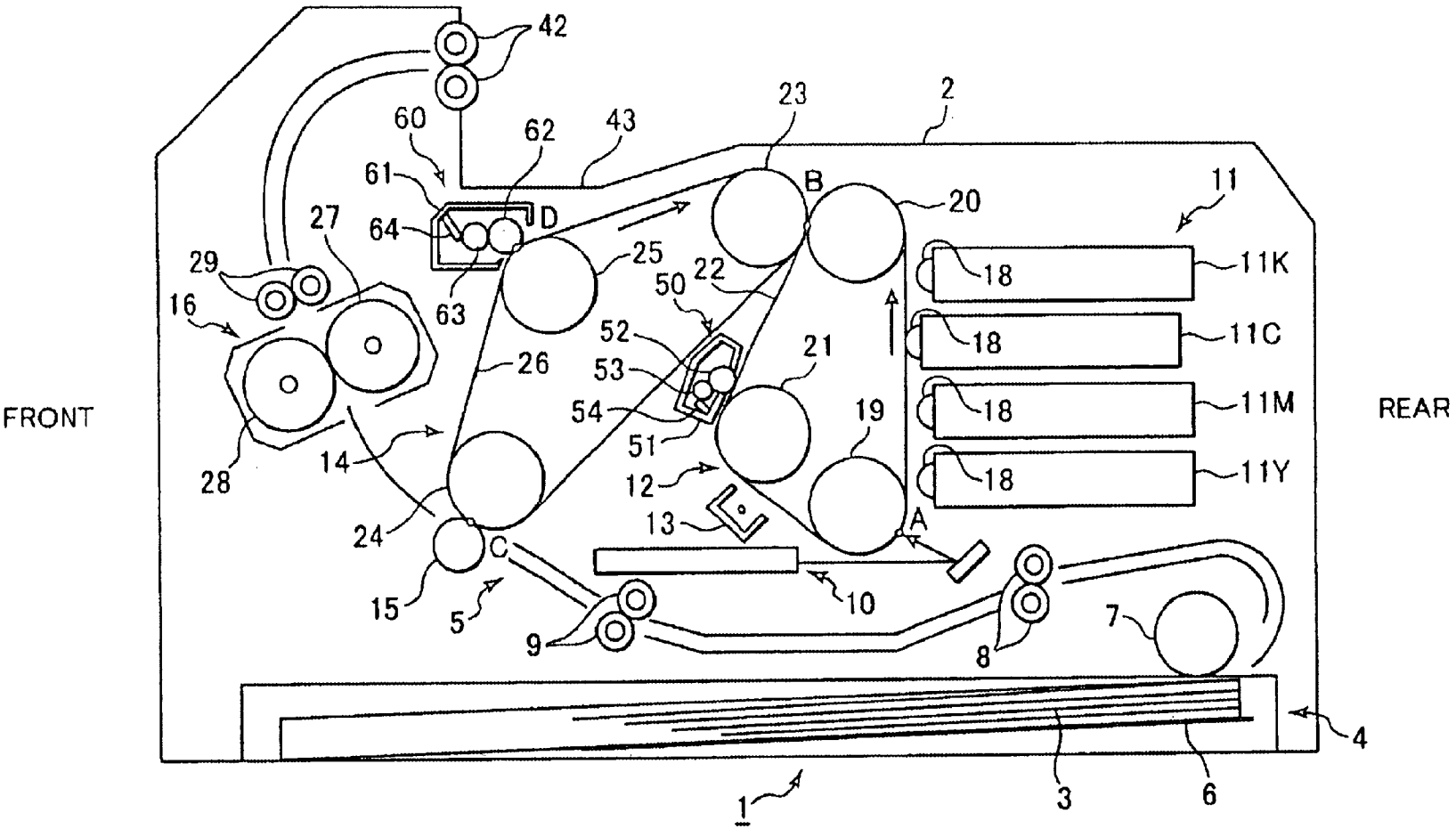
FIG. 1 is a printer.

As shown in FIG. 1, the printer 1 includes a casing 2, a sheet-supply unit 4, an image forming unit 5, a photosensitive belt cleaning unit 50, and an intermediate transfer belt cleaning unit 60.

The sheet-supply unit 4 is for supplying sheets, and includes a sheet-supply tray 6, a sheet-supply roller 7, a feed roller 8, and a register roller 9. The sheet-supply tray 6 holds a stack of sheets 3. The sheet-supply roller 7 presses on the uppermost sheet 3 of the stack in the sheet-supply tray 6. Rotation of the sheet-supply roller 7 pulls one sheet 3 at a time from the top of the stack and transports the same to the feed roller 8 and further to the register roller 9. Then, the sheet 3 is transported to the image forming unit 5.

The image forming unit 5 is for forming images onto supplied sheets 3, and includes a scanner unit 10, a developing unit 11, a photosensitive belt mechanism 12, a scorotron charge unit 13, an intermediate transfer belt mechanism 14, a transfer roller 15, and a fixing unit 16.

The scanner unit 10 is for performing exposure operations to form an electrostatic latent image on a photosensitive belt 22 (described later) based on image data. Although not shown in the drawings, the scanner unit 10 includes a laser emitting unit for emitting laser light, a polygon mirror for scanning the laser light following a scan direction perpendicular to the rotational direction of the photosensitive belt 22, a reflection mirror for designating the light path of the laser light, and a lens for focusing the laser light. Laser light that was emitted by the laser emitting unit based on image data irradiates the surface of the photosensitive belt 22 at an exposure point A via the polygon mirror, the reflection mirror, the lens and the like, thereby forming an electrostatic latent image on the surface of the photosensitive belt 22.

The developing unit 11 is disposed at the rear portion of the casing 2 and includes developing cartridges 11C, 11M, 11Y, and 11K, which are aligned vertically separated by a predetermined distance from each other. The developing cartridges 11C, 11M, 11Y, and 11K each store magnetic toner as a developing agent in the corresponding color of cyan (C), magenta (M), yellow (Y), and black (BK).

The developing cartridges 11C, 11M, 11Y, and 11K each includes a developing roller 18 and, although not shown in the drawings, a layer-thickness regulating blade, a supply roller, and a toner holding portion A cartridge drive mechanism (not shown) moves the developing cartridges 11C, 11M, 11Y, and 11K horizontally to selectively bring the developing roller 18 of the developing cartridges 11C, 11M, 11Y, and 11K into and out of contact with the surface of the photosensitive belt 22. Each of the developing cartridges 11C, 11M, 11Y, and 11K operates in substantially the same manner. That is, rotation of the supply roller supplies the toner housed in the toner holding portion to the developing roller 18, and the layer-thickness regulating blade regulates the thickness of the toner on the developing roller 18. When the developing roller 18 contacts the surface of the photosensitive belt 22 in this condition, the toner borne on the surface of the developing roller 18 is selectively transferred onto the photosensitive belt 22, thereby developing the electrostatic latent image into a visible toner image on the photosensitive belt 22.

The photosensitive belt mechanism 12 is disposed in front of the developing unit 11 in confrontation with the developing unit 11. The photosensitive belt mechanism 12 includes mainly a first photosensitive belt roller 19, a second photosensitive belt roller 20, a third photosensitive belt roller 21, and the photosensitive belt 22.

The first photosensitive belt roller 19 is disposed in substantial confrontation with the yellow developing cartridge 11Y, which is at the lowest position in the stack of developing cartridges. The second photosensitive belt roller 20 is disposed vertically above the first photosensitive belt roller 19 in substantial confrontation with the black developing cartridge 11K, which is at the highest position in the stack of developing cartridges. The third photosensitive belt roller 21 is disposed diagonally above the first photosensitive belt roller 19 and diagonally below the second photosensitive belt roller 20.

The photosensitive belt 22 is an endless belt provided with an organic photosensitive layer on its surface. The photosensitive belt 22 is wound around the photosensitive belt rollers 19, 20, to 21. That is, the photosensitive belt 22 is mounted in contact with the outer surface of the photosensitive belt rollers 19 to 21, which are disposed in a triangular arrangement. When a motor (not shown) drives the second photosensitive belt roller 20 to rotate, then the photosensitive belt 22 rotates around the photosensitive belt rollers 19 to 21 in the counterclockwise direction shown in FIG. 1.

The scorotoron charge unit 13 includes a charge wire, made from tungsten for example, that generates a corona discharge to charge the surface of the photosensitive belt 22 to a uniform positive charge The scorotoron charge unit 13 is disposed below the photosensitive belt mechanism 12 at a position between the third photosensitive belt roller 21 and the first photosensitive belt roller 19 and separated from the photosensitive belt 22 by a predetermined distance It should be noted that the scorotron charge unit 13 charges the surface of the photosensitive belt 22 as a preprocess of the exposure operations by the scanner unit 10.

The intermediate transfer belt mechanism 14 is disposed to the front of the photosensitive belt mechanism 12, and includes mainly a first intermediate transfer belt roller 23, a second intermediate transfer belt roller 24, a third intermediate transfer belt roller 25, and an intermediate transfer belt 26.

The first intermediate transfer belt roller 23 is disposed in substantial confrontation with the second photosensitive belt roller 20 via the photosensitive belt 22 and the intermediate transfer belt 26. The second intermediate transfer belt roller 24 is disposed to the front of and below the first intermediate transfer belt roller 23. The third intermediate transfer belt roller 25 is disposed above the second intermediate transfer belt roller 24 and below and to the front of the first intermediate transfer belt roller 23.

The intermediate transfer belt 26 is an endless belt made from a conductive resin, such as polyamide or polycarbonate, which is dispersed with conductive particles, such as carbon. The intermediate transfer belt 26 is wound around the intermediate transfer belt rollers 23 to 25.

Figure 2:
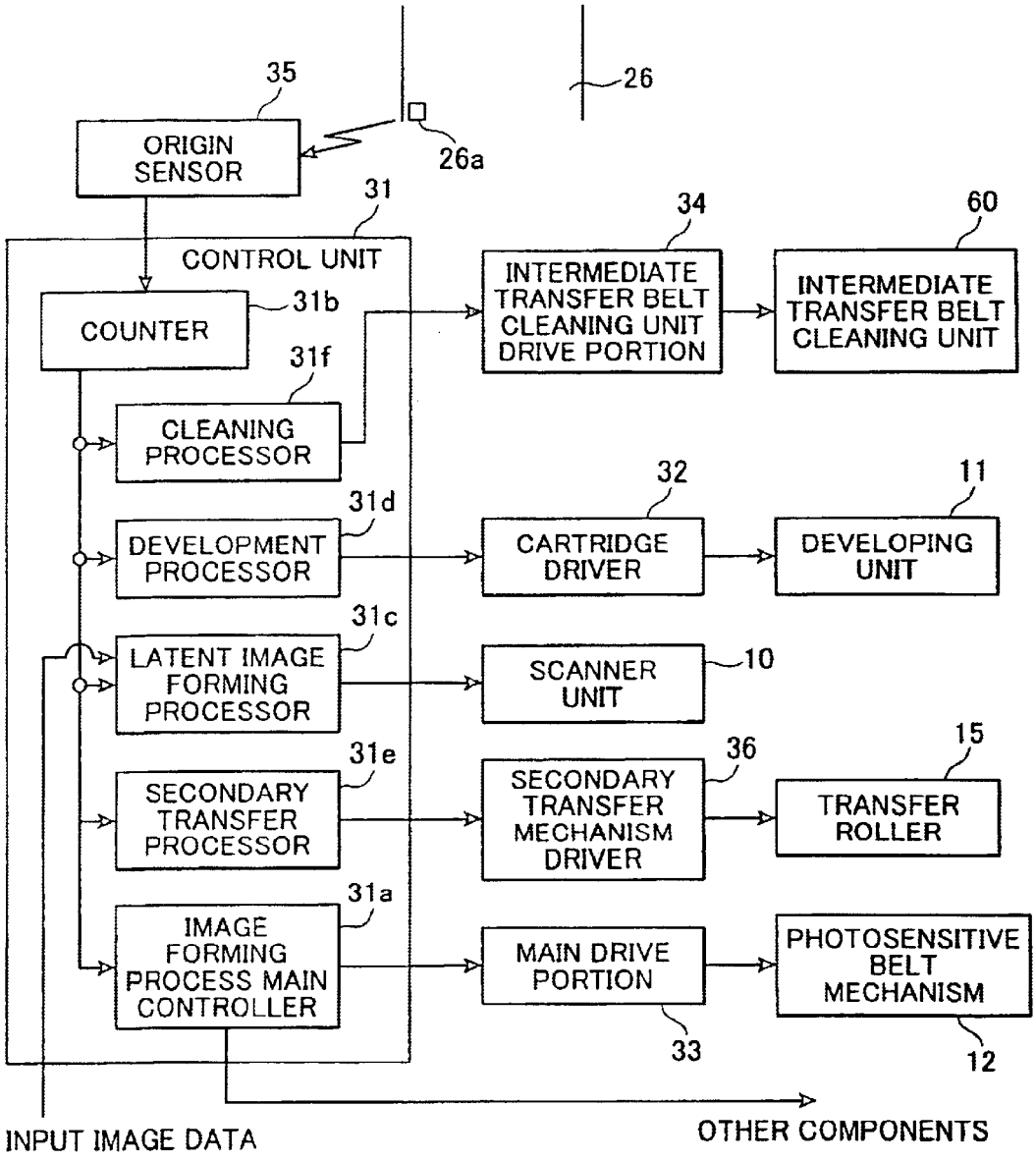
FIG. 2 is a block diagram showing electrical configuration of the printer of FIG. 1.

The intermediate transfer belt 26 is disposed to contact the photosensitive belt 22 at a primary transfer point B between the first intermediate transfer belt roller 23 and the second photosensitive belt roller 20. This contact generates friction F between the intermediate transfer belt 26 and the photosensitive belt 22. The friction F moves the intermediate transfer belt 26 to follow the rotational movement of the photosensitive belt 22, so that the intermediate transfer belt 26 rotates around the periphery of the intermediate transfer belt rollers 23 to 25 in the clockwise direction of FIG. 1 as the photosensitive belt 26 rotates in the counterclockwise direction. The intermediate transfer belt 26 includes a marker 26*a*, which indicates an origin of the intermediate transfer belt 26. As shown in FIG. 2, the marker 26*a* is a hole in the present embodiment. The marker 26*a* enables a control unit 31 to be described later to keep track of rotational movement of the intermediate transfer belt 26.

The transfer roller 15 is disposed in substantial confrontation with the second intermediate transfer belt roller 24 through the intermediate transfer belt 26, and driven into and out of contact with the intermediate transfer belt 26 at a position downstream from the primary transfer point B in the moving direction of the intermediate transfer belt 26. The transfer roller 15 is applied with a predetermined transfer bias by a transfer bias application circuit (not shown) and presses a sheet 3 against the intermediate transfer belt 26.

The fixing unit 16 is disposed to the front of the intermediate transfer belt mechanism 14 and at a position downstream in the sheet transport direction, and includes a thermal roller 27, a pressing roller 28, and a pair of transport rollers 29. The thermal roller 27 is configured from an internal metal layer, an external silicone rubber layer, and a halogen lamp for heating up the metal and silicone rubber layers. The pressing roller 28 presses against the thermal roller 27. The pair of transport rollers 29 are positioned downstream from the thermal roller 27 and the pressing roller 28 in the transport direction of the sheet 3. After the image forming unit 5 forms a color image on a sheet 3, the sheet 3 passes between the thermal roller 27 and the pressing roller 28 so that the color image is thermally fixed onto the sheet 3.

The photosensitive belt cleaning unit 50 is for cleaning the photosensitive belt 22. The photosensitive belt cleaning unit 50 is fixedly disposed on the opposite side of the photosensitive belt mechanism 12 than the developing unit 11 and at a position downstream from the primary transfer point B with respect to the rotational direction of the photosensitive belt 22.

The intermediate transfer belt cleaning unit 60 is for cleaning the intermediate transfer belt 26, and is disposed in confrontation with the third intermediate transfer belt roller 25 through the intermediate transfer belt 26.

As shown in FIG. 2, the printer 1 further includes the control unit 31 for performing overall control of the components described above. The control unit 31 includes internal components such as a central processing unit (CPU), a read only memory (ROM), and a random access memory (RAM). The control unit 31 includes an image forming process main controller 31*a*, a secondary transfer processor 31*e*, a latent image forming processor 31*c*, a development processor 31*d*, a cleaning processor 31*f*, and a counter 31*b*. When image forming processes start, the image forming process main controller 31*a* is started up.

The image forming process main controller 31*a* performs initialization operations on all components that are subject to control operations during the image forming processes, and also performs controls for various components, with the exception of controls relating to latent image formation, development, secondary transfer, and cleaning of the intermediate transfer belt 26. For example, the image forming process main controller 31*a* is connected to the photosensitive belt mechanism 12 through a main drive portion 33. When the image forming process main controller 31*a* inputs a control signal to the main drive portion 33, then the main drive portion 33 drives the photosensitive belt mechanism 12 using a motor (not shown) provided to the main drive portion 33.

The secondary transfer processor 31*e* is connected to the transfer roller 15 through a secondary transfer mechanism driver, and the latent image forming processor is connected to the scanner unit 10. The development processor 31*d* is connected to the developing unit 11 through the cartridge driver 31, and the cleaning processor 31*f* is connected to the intermediate transfer belt cleaning unit 60 through an intermediate transfer belt cleaning unit drive portion 34.

The counter 31*b* is connected to an origin sensor 35 that detects the marker 26*a* of the intermediate transfer belt 26 and output detection signals. Based on the detection signals form the origin sensor 35, the counter 31*b* measures the time that elapses from the time when the marker 26*a* passes by a predetermined location. Because the intermediate transfer belt 26 of the present embodiment is configured to rotate at a predetermined speed, the elapsed time measured by the counter 31*b* can be used as a parameter that represents a coordinate position of the intermediate transfer belt 26, wherein the marker 26*a* serves as a reference point.

Next, an explanation will be provided for the image forming operations of the printer 1.

When the printer 1 starts image forming operations, the scorotron charge unit 13 starts charging the surface of the photosensitive belt 22 to the positive uniform charge. The latent image forming processor 31*c* starts driving the scanner unit 10 at a predetermined timing to form an electrostatic latent image that corresponds to a cyan image on the surface of the photosensitive belt 22.

Explained in more detail, laser light from the scanner unit 10 irradiates based on input image data the positively charged surface of the photosensitive belt 22 at the exposure point A. This changes the electric potential at the surface of the photosensitive belt 22 that has been positively and uniformly charged, thereby forming an electrostatic latent image on the surface of the photosensitive belt 22. Rotation of the photosensitive belt 22 transports thus formed electrostatic latent image toward the developing unit 11 located downstream from the exposure point A with respect to the rotational direction of the photosensitive belt 22.

The development processor 31*d* inputs a control signal to a cartridge driver 32 at a predetermined timing before the electrostatic latent image reaches the developing unit 11. In response to the control signal, the cartridge driver 32 drives the above-mentioned drive cartridge drive mechanism to bring the developing roller 18 of the developing cartridge 11C into contact with the photosensitive belt 22. At this time, the developing rollers 18 of the magenta, yellow, and black developing cartridges 11M, 11Y, and 11K are kept separated from the photosensitive belt 22. As a result, the electrostatic latent image is developed into a cyan toner image on the photosensitive drum 22 when passing by the developing unit 11. After the development is completed, the developing roller 18 is separated from the photosensitive belt 22.

Rotation of the photosensitive belt 22 transports the cyan toner image to the primary transfer point B, where the toner image is transferred from the photosensitive belt 22 onto the intermediate transfer belt 26. This transfer is referred to as "primary transfer operations".

The photosensitive belt cleaning unit 50 removes from the surface of the photosensitive belt 22 any residual toner that was not transferred onto the intermediate transfer belt 26 during the primary transfer operation. In this way, the photosensitive belt 22 is cleaned up by the photosensitive belt cleaning unit 50.

Next, the photosensitive belt 22 is again charged to a uniform charge by the scorotron charge unit 13 and formed with an electrostatic latent image corresponding to a magenta image. The developing roller 18 of the magenta developing cartridge 11M is brought into contact with the photosensitive belt 22, and the developing rollers 18 of the cyan, yellow, and black developing cartridges 11C, 11Y, and 11K are maintained separated from the photosensitive belt 22. As a result, the electrostatic latent image that corresponds to a magenta image is developed on the photosensitive belt 22 into a magenta toner image, which is then transferred at the primary transfer point B onto the cyan toner image that was transferred onto the intermediate transfer belt 26 during the previous operation.

The same operations are performed for the other colors of yellow and black so that a multicolor toner image made from cyan (C), magenta (M), yellow (Y), and black (BK) toner is formed on the surface of the intermediate transfer belt 26.

Afterward, the secondary transfer processor 31*e* controls a secondary transfer mechanism driver 36 to move the transfer roller 15 into contact with the intermediate transfer belt 26. Also, a sheet 3 that was transported from the sheet-supply tray 6 passes between the transfer roller 15 and the intermediate transfer belt 26 at the same time that the multicolor toner image passes between the transfer roller 15 and the intermediate transfer belt 26. As a result, the multicolor image is transferred onto the sheet 3, thereby forming a color image on the surface of the sheet 3. This transfer is referred to as "secondary transfer operations".

After the secondary transfer is completed, the sheet 3 is transported to the fixing unit 16, which fixes the color image onto the sheet 3. Then, the pair of transport rollers 29 transport the sheet 3 to a pair of sheet discharge rollers 42, which discharges the sheet 3 onto a sheet discharge tray 43 formed on the top of the casing 2.

Next, the photosensitive belt cleaning unit 50 will be explained. As shown in FIG. 1, the photosensitive belt cleaning unit 5D includes a photosensitive belt cleaning box 51, a photosensitive belt cleaning roller 52, a secondary photosensitive belt cleaning roller 53, and a photosensitive belt cleaning blade 54.

The photosensitive belt cleaning box 51 has a box shape with an opening at the side that confronts the photosensitive belt 22. The space at the bottom of the photosensitive belt cleaning box 51 forms a waste-toner accumulation portion for accumulating toner that is scraped off by the photosensitive belt cleaning blade 54.

The photosensitive belt cleaning roller 52 is a resilient member made from silicone rubber, for example, and is rotatably supported at the opening in the photosensitive belt cleaning box 51 at a position near the third photosensitive belt roller 21. The photosensitive belt cleaning roller 52 is constantly in contact with the photosensitive belt 22 and rotates in the same direction as the photosensitive belt 22. Although not shown in the drawings, a cleaning bias application circuit is provided to apply a predetermined cleaning bias to the photosensitive belt cleaning roller 52 with respect to the photosensitive belt 22.

The secondary photosensitive belt cleaning roller 53 is formed from a metal roller and disposed so as to contact the photosensitive belt cleaning roller 52 from the opposite side of the photosensitive belt cleaning roller 52 than the photosensitive belt 22. The secondary photosensitive belt cleaning roller 53 is applied with a predetermined bias with respect to the photosensitive belt cleaning roller 52.

The photosensitive belt cleaning blade 54 is formed from a thin plate-shaped blade, and contacts the secondary photosensitive belt cleaning roller 53 at a side opposite from the photosensitive belt cleaning roller 52 to scrape toner from the surface of the secondary photosensitive belt cleaning roller 53.

With this configuration, the photosensitive belt cleaning roller 52 electrically picks up toner that remains on the photosensitive belt 22 after the primary transfer operation. Then, the secondary photosensitive belt cleaning roller 53 electrically picks up the toner that clings to the photosensitive belt cleaning roller 52. Further, the photosensitive belt cleaning blade 54 removes the toner from the secondary photosensitive belt cleaning roller 53, whereupon the toner is collected in the waste toner accumulation portion. In this way, toner that remains after the primary transfer operation is removed as it passes by the photosensitive belt cleaning unit 50 so that the photosensitive belt 22 can be cleaned.

Figure 3A:
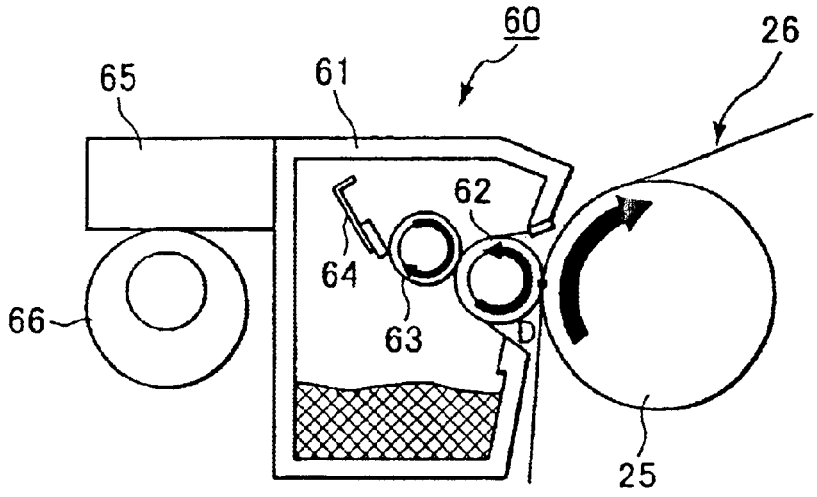
FIGS. 3 (*a*)–3 (*b*) are cross-sectional views schematically showing a cleaning unit provided in the printer of FIG. 1 for cleaning an intermediate transfer member of the printer.
Figure 3B:
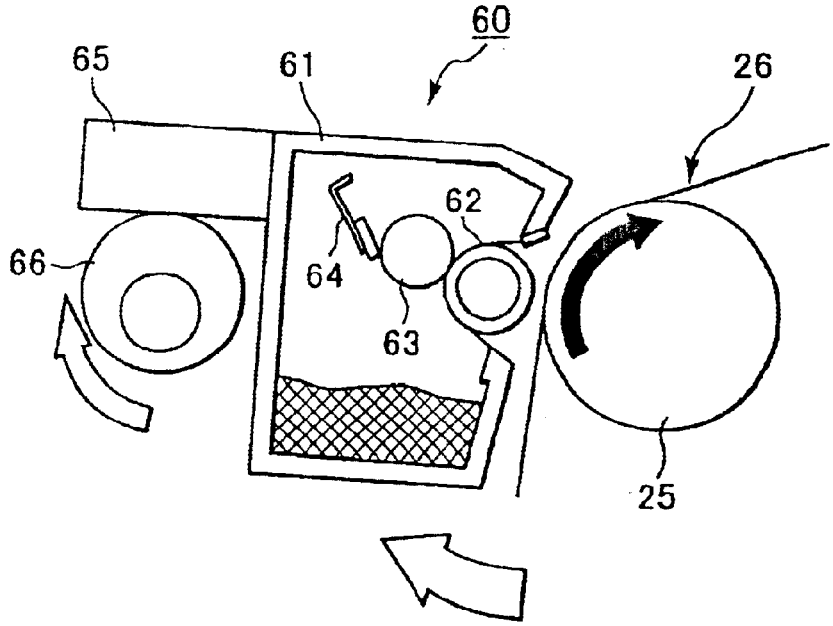

Next, the intermediate transfer belt cleaning unit 60 will be explained. The intermediate transfer belt cleaning unit 60 is for cleaning the intermediate transfer belt 26 by removing residual toner that remains on the intermediate transfer belt 26 after the secondary transfer operation in order to swingably supported to the casing 2. As shown in FIG. 3(*a*), the intermediate transfer belt cleaning unit 60 includes an intermediate transfer belt cleaning box 61, an intermediate transfer belt cleaning roller 62, a secondary transfer belt 63, an intermediate transfer belt cleaning blade 64, a protrusion 65, and an oval rotation portion 66.

The intermediate transfer belt cleaning box 61 has a box shape formed with an opening at the side in confrontation with the intermediate transfer belt 26. The space at the bottom of the intermediate transfer belt cleaning box 61 forms a waste-toner accumulation portion for accumulating toner that is scraped off by the intermediate transfer belt cleaning blade 64.

The intermediate transfer belt cleaning roller 62 is made from a metal roller that is rotatably supported at the opening of the intermediate transfer belt cleaning box 61 at a position in confrontation with the third intermediate transfer belt roller 25. Also, the intermediate transfer belt cleaning roller 62 is applied with a predetermined cleaning bias with respect to the intermediate transfer belt 26.

The secondary transfer belt 63 has substantially the same configuration as the secondary photosensitive belt cleaning roller 53 of the photosensitive belt cleaning unit 50 and is disposed in contact with the intermediate transfer belt cleaning roller 62. The intermediate transfer belt cleaning blade 64 has substantially the same configuration as the photosensitive belt cleaning blade 54 and is disposed in contact with the secondary transfer belt 63.

The protrusion 65 protrudes from a side of the intermediate transfer belt cleaning box 61 opposite from the intermediate transfer belt 26. The oval rotation portion 66 contacts the protrusion 65 and is supported on the casing 2 so as to be rotatable around a rotational axis that is shifted from the oval center.

With this configuration, the intermediate transfer belt cleaning roller 62 can be brought into and out of contact with the intermediate transfer belt 26 as the oval rotation portion 66 rotates.

That is, to switch the intermediate transfer belt cleaning unit 60 from a contact condition shown in FIG. 3(*a*) to a separation condition shown in FIG. 3(*b*), the cleaning processor 31*f* shown in FIG. 2 drives the intermediate transfer belt cleaning unit drive portion 34 to rotate the oval rotation portion 66. As a result, the protrusion 65 is raised upward and the intermediate transfer belt cleaning roller 62 tilts downward toward the intermediate transfer belt 26. This separates the intermediate transfer belt cleaning roller 62 from the intermediate transfer belt 26.

To switch the intermediate transfer belt cleaning unit 60 from the separation condition shown in FIG. 3(*b*) into the contact condition shown in FIG. 3(*a*), the cleaning processor 31*f* controls the intermediate transfer belt cleaning unit drive portion 34 to drive the oval rotation portion 66 to rotate. As a result, the protrusion 65 moves downward from its raised position so that the intermediate transfer belt cleaning roller 62 is raised upward toward the intermediate transfer belt 26. This brings the intermediate transfer belt cleaning roller 62 into contact with the intermediate transfer belt 26.

When intermediate transfer belt cleaning unit 60 is in the contact condition as shown in FIG. 3(*a*), the intermediate transfer belt cleaning roller 62 electrically catches residual toner clinging to the intermediate transfer belt 26, and the secondary transfer belt 63 electrically catches the toner that was caught by and that clings to the intermediate transfer belt cleaning roller 62. Then, the intermediate transfer belt cleaning blade 64 scrapes the toner off the secondary transfer belt 63 whereupon the toner accumulates in the waste toner accumulation portion.

Here, the cleaning processor 31*f* controls the intermediate transfer belt cleaning unit drive portion 34 at a predetermined timing that meets the following conditions. That is, the intermediate transfer belt cleaning unit 60 is maintained at its separation condition, where the intermediate transfer belt cleaning roller 62 is separated from the intermediate transfer belt 26 by a predetermined distance, until all of the four colors of toner images are primarily transferred onto the surface of the intermediate transfer belt 26. Then, the intermediate transfer belt cleaning unit 60 is brought into its contact condition, where the intermediate transfer belt cleaning roller 62 is in contact with the intermediate transfer belt 26, before the residual toner clinging on the intermediate transfer belt 26 after the secondary transfer operation reaches a cleaning point D, which is the position where the intermediate transfer belt cleaning roller 62 abuts against the intermediate transfer belt 26.

Figure 4:
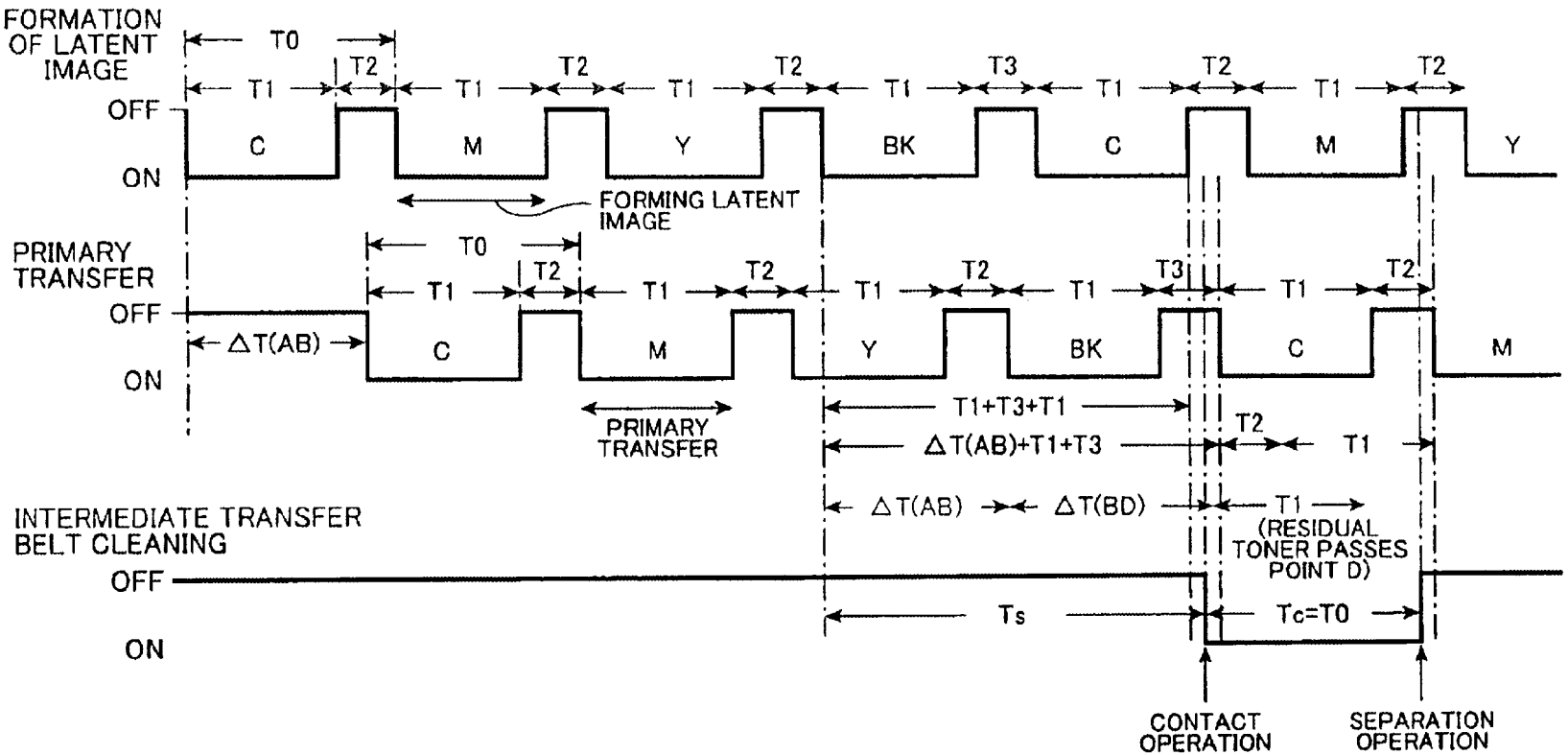
FIG. 4 is a time chart representing timing of switching operations of the cleaning unit.

Next, the timing to switch the intermediate transfer belt cleaning unit 60 between the contact condition and the separation condition will be described with reference to FIG. 4. FIG. 4 is a timing chart representing the relationships among timing of latent-image forming operation, timing of primary transfer operations, and timing of switching the intermediate transfer belt cleaning unit 60 between the contact condition and the separation condition. It should be noted that an operation for switching the intermediate transfer belt cleaning unit 60 from the separation condition to the contact condition will be referred to as "contact operation", and an operation for switching the intermediate transfer belt cleaning unit 60 from the contact condition to the separation condition will be referred to as "separation operation", hereinafter.

Figure 5:
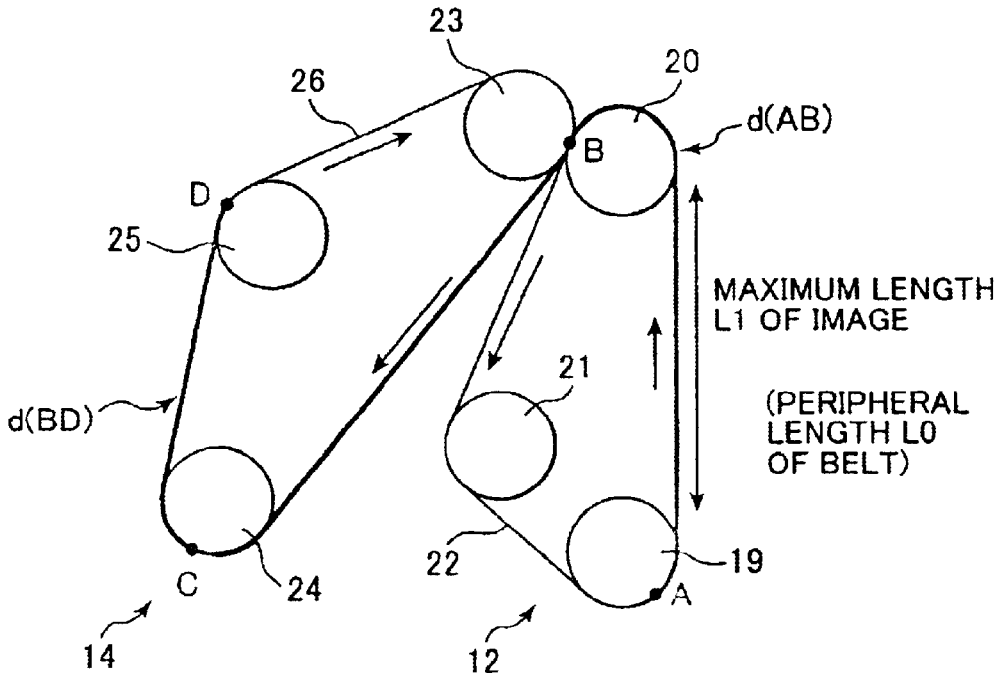
FIG. 5 is a schematic side view showing positional relationships between an exposure point, a primary transfer point, and a cleaning point.

FIG. 5 is a schematic view for explaining the positional relationship of the exposure point A, the primary transfer point B, and the cleaning point D.

The following explanation will be provided assuming that during image forming operations, the main drive portion 33 rotates the photosensitive belt 22 and thus the intermediate transfer belt 26 at a fixed rotational speed v, and that the printer 1 is forming the maximum-sized image that the printer 1 is capable of forming. Also, operations to be described below are executed by the latent image forming processor 31*c* and the cleaning processor 31*f* of the control unit 31 at the timings shown in FIG. 4 while referring to the elapsed time measured by the counter 31*b*.

When the image forming operations are started, as shown in FIG. 4 the latent image forming processor 31*c* executes latent image forming operations for cyan, magenta, yellow, and black in this order at a predetermined cycle T0 to form the electrostatic latent images for these colors on the photosensitive belt 22. Because the cycle T0 equals to a rotation cycle T0 of the intermediate transfer belt 26, the cycle T0 is expressed by a formula:

$$T0=Lc/v$$

wherein Lc is a total length around the periphery of the intermediate transfer belt 26; and v is the rotational speed of the photosensitive belt 22.

That is, the latent image forming processor 31*c* controls the scanner unit 10 to perform the exposure operations. During this exposure operations, the latent image forming processor 31*c* controls scanner unit 10 to perform the latent image forming operations for a latent-image forming time T1, which corresponds to the size of the image to be formed, and not to perform the latent image forming operations for a no-image forming time T2 until the next latent image forming operation starts. The latent image forming processor 31*c* repeats this control of performing and not performing the latent image forming operations for a plurality of times, that is, for four times in the present embodiment. Here, the no-image forming time T2 is expressed in the following formula:

$$T2=T0-T1$$

wherein T0 is the rotation cycle of the intermediate transfer belt 26; and T1 is the latent-image forming time, which is the maximum latent-image forming time of the printer 1 in this example.

Also, the latent-image forming time T1 is expressed in the following formula:

$$T1=L1/v$$

wherein L1 is a length of the maximum-sized toner image that the printer 1 can form with respect to the peripheral direction of the photosensitive belt 22; and v is the rotational speed of the photosensitive belt 22.

The primary transfer operation starts at the primary transfer point B when a fixed delay time ΔT(AB) has elapsed after the corresponding latent image forming operation was started. The fixed delay time ΔT(AB) is calculated by a formula:

$$\Delta T(AB)=d(AB)/v$$

wherein d(AB) is a movement distance of the photosensitive belt 22 from the exposure point A to the primary transfer point B; and v is the rotational speed of the photosensitive belt 22.

Then, the toner image transferred onto the intermediate transfer belt 26 reaches the cleaning point D after a fixed delay time ΔT(BD), which is calculated by a formula:

$$\Delta T(BD)=d(BD)/v$$

wherein d(BD) is a movement distance of the intermediate transfer belt 26 from the primary transfer point B to the cleaning point D; and v is the rotational speed of the intermediate transfer belt 26.

Then, the toner image on the intermediate transfer belt 26 again reaches the primary transfer point B after a time ΔT(DB), whereupon a primary transfer operation is again performed for a next color image. The time ΔT(DB) is calculated by a formula:

$$\Delta T(DB)=d(DB)/v$$

wherein d(DB) is a movement distance of the intermediate transfer belt 26 from the cleaning point D to the primary transfer point B; and v is the rotational speed of the intermediate transfer belt 26.

Accordingly, $$\Delta T(DB)=T0-\Delta T(BD)$$

As shown in FIG. 4, the intermediate transfer belt cleaning unit 60 is maintained at the separation condition until the primary transfer operations for all of the cyan to black toner images that correspond to image data are completed. Afterward, the intermediate transfer belt cleaning unit 60 is switched into the contact condition at a predetermined timing that is before the leading edge of residual toner from the secondary transfer operations reaches the cleaning point D and that is during a period where neither a latent image forming operation nor a primary transfer operation is being performed.

The intermediate transfer belt cleaning unit 60 is again switched into the separation contacting condition at a predetermined timing that is after all of the residual toner from the secondary transfer operation is collected, that is, after the tail edge portion of the residual toner passes through the cleaning point D, and that is during a period wherein neither a latent image forming operation nor a primary transfer operation is being performed.

If the latent image forming operations for a subsequent set of image data are not started after a multicolor toner image for a previous set of image data is formed onto a sheet 3 until the intermediate transfer belt cleaning unit 60 completes cleaning of the intermediate transfer belt 26, then the time required for processing a plurality of consecutive image data sets would increase. Therefore, in the present embodiment, as shown in FIG. 4 the latent image forming operation that corresponds to a subsequent set of image date is started before the intermediate transfer belt cleaning unit 60 completes cleaning of the intermediate transfer belt 26. In concrete terms, when latent image forming operations for a black image for a previous set of image data is completed, latent image forming operations for a cyan image for a subsequent set of image data is stated after a next-image movement time T3 elapses. In the present embodiment, the next-image movement time T3 is set equal to the no-image forming time T2.

According to the embodiment, the primary transfer point B and the like are set in the following manner so that the intermediate transfer belt cleaning unit 60 can be switched between the contact condition and the separation condition at the timing described above.

Firstly, the primary transfer point B is designated so as that the following relationship is fulfilled:

$$T1<\Delta T(AB)<T0$$

or, in terms of distance;

$$L1<d(AB)<Lc$$

wherein Lc is the peripheral length of the intermediate transfer belt 26. When these relationships are fulfilled, primary transfer operations will start during a period wherein no latent image forming operation is being performed, but not for a fixed time after latent image forming operations are stopped. That is, a time wherein neither a latent image forming operation nor a primary transfer operation is being performed can be designated.

Secondly, the cleaning point D is set at a position to fulfill the following relationship:

$$2T1+T3-\Delta T(AB)<\Delta T(BD)<T0<T1+T2+T3.$$

By this, it is possible to perform the contact and separating operations of the intermediate transfer belt cleaning unit 60 at timing wherein no latent image forming operation or primary transfer operation is performed in order to remove only residual toner that remains from a secondary transfer operation.

Thirdly, the next-image movement time T3 is set equal to the no-image forming time T2 as mentioned above. Also, the peripheral length L0 of the photosensitive belt 22 is set to less than the peripheral length of the intermediate transfer belt 26 (L0<Lc). The primary transfer point B is set at a position that satisfies the relationship L1<d(AB)<L0, and the cleaning point D is set to a position that satisfies the relationship of L1<Lc+L1−d(AB)<d(BD)<Lc. With this, the leading edge of residual toner remaining from a secondary transfer operation will reach the cleaning point D during a time wherein no latent image forming operation or primary transfer operation is being performed. This makes possible to perform the contact operation of the intermediate transfer belt cleaning unit 60 during the period wherein neither a latent image forming operation nor a primary transfer operation is being performed. Further, by setting the cleaning point D to fulfill the relationship of T(BD)>T1, that is, d(BD)>L1 , the leading edge of residual toner from a secondary transfer operation will still have not reached the cleaning point D by the time that the primary transfer operation of the black toner image is completed. Accordingly, it is possible to to perform the separation operation of the intermediate transfer belt cleaning unit 60 during the period wherein neither a latent image forming operation nor a primary transfer operation is being performed.

An elapsed time Ts from when the latent image forming operation corresponding to the black toner image starts until the contact operation to bring the intermediate transfer belt cleaning unit 60 into toe contact condition is set to fulfill the following relationship:

$$2T1+T3=T0+T1<Ts<\Delta T(AB)+\Delta T(BD)$$

Also, the separating operation is performed after a time Tc=T0 from the contact operation.

With this configuration, the separation operation is performed at a timing that is after the trailing edge of the residual toner from a secondary transfer operation passes by the cleaning point D, before the next cyan-toner image that was transferred to the intermediate transfer belt 26 in a primary transfer operation reaches the cleaning point D, and also during a period wherein no latent image forming operation or primary transfer operation is being performed.

As mentioned above, the intermediate transfer belt 26 vibrates when the intermediate transfer belt cleaning roller 62 is switched between the contact condition and the separation condition. Also, the resultant temporary fluctuation in rotational load of the photosensitive belt 22 and the intermediate transfer belt 26 can temporarily change the rotational speed of the photosensitive belt 22 and intermediate transfer belt 26. These can result in image distortion during latent image forming operations to form an electrostatic latent image and shift in position where different colored images are transferred during primary transfer operations. However, these problems can be suppressed because the intermediate transfer belt cleaning unit 60 of the present embodiment can be switched into and out of contact with the intermediate transfer belt 26 while no latent image forming operation or primary transfer operation is being performed. Therefore, distortion in the output image formed on the sheet 3 after the secondary transfer operation can be sufficiently suppressed.

In particular, in contrast to conventional image forming devices, the image forming device according to the present embodiment prevents distortion of the latent image that can be caused by vibration during formation of the electrostatic latent image, which is a process that can easily influence the image output after the secondary transfer operation. Therefore, distortion in the output image can be efficiently suppressed.

Also, because the above timing control of the intermediate transfer roller cleaning unit 60 is performed in the cleaning processor 31*f* of the control unit 31, residual toner removal can be performed at the desired timing by merely performing a simple control operation in the cleaning processor 31*f*.

In the present embodiment, a friction force f that is generated between the intermediate transfer belt 26 and the intermediate transfer belt cleaning roller 62 at the time of when the intermediate transfer belt cleaning unit 60 is switched into the contact condition is set smaller than a friction force F that is generated between the intermediate transfer belt 26 and the photosensitive belt 22 at the primary transfer point B (f<F). Therefore, the Intermediate transfer belt 26 will not slide across the surface of the photosensitive belt 22 even if the rotational load on the intermediate transfer belt 26 increases for the instant that the intermediate transfer belt cleaning roller 62 first contacts the intermediate transfer belt 26. As a result, the intermediate transfer belt 26 can be rotated at the same speed as the photosensitive belt 22. Accordingly, toner images from the primary transfer operation will not be shifted out of position or distorted from the action of the intermediate transfer belt cleaning roller 62 contacting the intermediate transfer belt 26, so that the different colored images can be prevented from being shifted out of alignment with each other when stacked on top of each other at the primary transfer point B.

Here, it is possible to configure a bearing of the second photosensitive belt roller 20 to be movable and connecting a bearing of the first intermediate transfer belt roller 23 using a spring such that the photosensitive belt 22 can be set to contact the intermediate transfer belt 26 with the friction force F that is greater than the friction force f. With this configuration, fluctuation in the friction force F can be suppressed even if the printer 1 is vibrated, and fluctuation in the rotational load on the photosensitive belt 22 and the intermediate transfer belt 26 can be suppressed.

In the above embodiment, the rotational force of the photosensitive belt 22 is transmitted to the intermediate transfer belt 26 by the friction force F so as to rotate the intermediate transfer belt 26 in linked association with the photosensitive belt 22. However, this configuration is not a limitation of the present invention. When the intermediate transfer belt 26 and the photosensitive belt 22 are rotated in linked association by the friction force generated by their mutual contact, the intermediate transfer belt 26 and the photosensitive belt 22 can easily slide at their contact surfaces due to fluctuation in the rotational load of the intermediate transfer belt 26 generated by the contact or separation operation of the intermediate transfer belt cleaning unit 60. However, this slippage can be easily prevented by the following configuration.

Figure 6:
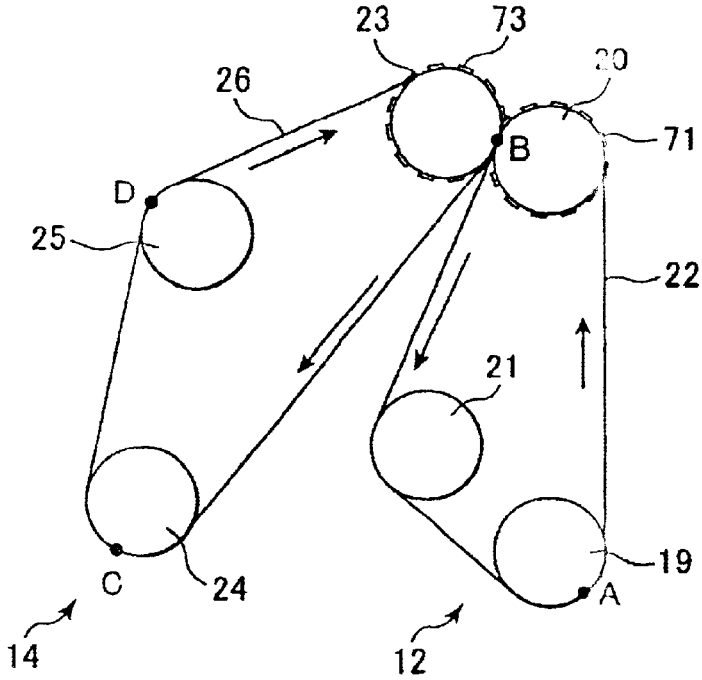
FIG. 6 is a schematic side view showing configuration of a photosensitive belt mechanism and an intermediate transfer belt mechanism according to a modification of the first embodiment.

For example, as in FIG. 6, gears 71 and 73 could be provided on the outer surfaces of the second photosensitive belt roller 20 and the first intermediate transfer belt roller 23 to connect the second photosensitive belt roller 20 and the first intermediate transfer belt roller 23 by meshing engagement between the gears 71, 73. The gear 73 follows rotation of the gear 71 that is driven by drive force of a drive motor (not shown) to which the motor 71 is connected, so that the intermediate transfer belt 26 and the photosensitive belt 22 can be rotated at the same speed.

With this configuration, the intermediate transfer belt 26 can be reliably prevented from slipping across the surface of the photosensitive belt 22. Accordingly, positional shifts between the different colored images, which can be caused by the contact and separation condition of the intermediate transfer belt cleaning roller 62 when the different colored toner images are transferred on top of each other by the primary transfer operations, can be prevented.

Figure 7A:
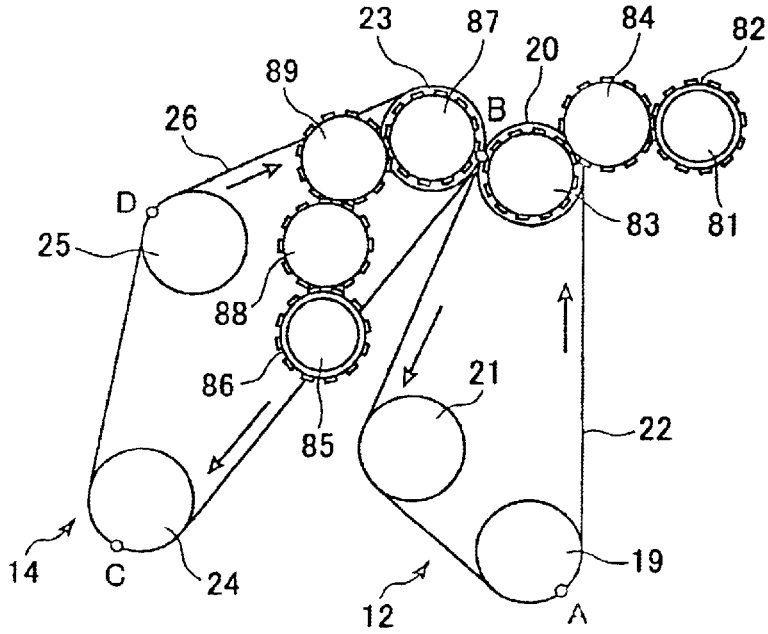
FIG. 7 (*a*) is a schematic side view showing configuration of a photosensitive belt mechanism and an intermediate transfer belt mechanism according to another modification of the first embodiment.
Figure 7B:
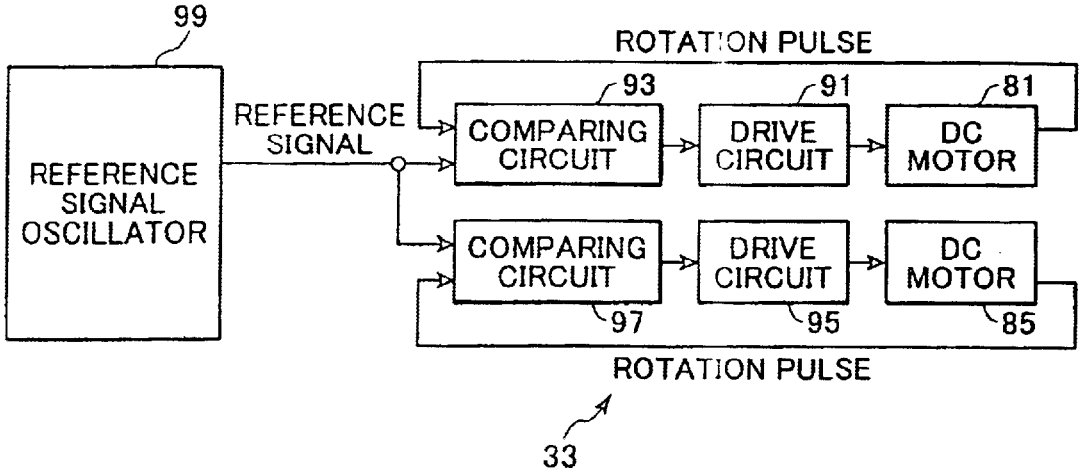

In an alternative example, the intermediate transfer belt 26 and the photosensitive belt 22 could be driven to rotate by different motors as shown in FIG. 7(*a*), and the rotational speed of the motors could be controlled using the same reference signal oscillator 99 shown in FIG. 7(*b*).

Described in more detail, the photosensitive belt mechanism 12 shown in FIG. 7(*a*) is additionally provided with gears 82, 83, and 84. The gear 82 is connected to a direct current (DC) motor 81. The gear 83 is connected to the second photosensitive belt roller 20. The gear 84 is for transmitting drive force from the gear 82 to the gear 83. Rotational force generated by the DC motor 81 is transmitted to the second photosensitive belt roller 20 through the gear 84 so drive the second photosensitive belt roller 20.

The intermediate transfer belt mechanism 14 shown in FIG. 7(*a*) is additionally provided with gears 86, 87, 88, and 89. The gear 86 is connected to a DC motor 85. The gear 87 is connected to the first intermediate transfer belt roller 23. The gears 88, 89 are for transmitting drive force from the gears 86 to 87. Rotational force generated by the DC motor 85 is transmitted to the first intermediate transfer belt roller 23 through the gears 86, 87, 88, 89 to drive the first intermediate transfer belt roller 23.

As shown in FIG. 7(*b*), the main drive portion 33 includes the DC motor 81 connected to the gear 82, a drive circuit 91 connected to the DC motor 81, a comparing circuit 93, the DC motor 85 connected to the gear 86, a drive circuit 95 connected to the DC motor 85, the comparing circuit 97, and the reference signal generating oscillator 99.

With this configuration, the comparing circuit 93 receives the rotation pulse from a sensor (not shown) that is incorporated in the DC motor 81 and outputs to the drive circuit 91 a drive signal based on the rotation pulse and on a reference signal from the reference signal generating oscillator 99. The drive circuit 91 supplies drive power based on the drive signal to the DC motor 81 to drive the drive motor 81 at a fixed rotational speed.

In the same way, the comparing circuit 97 receives a rotation pulse from a sensor of the drive motor 85 and outputs to the drive circuit 95 a drive signal based on the rotation pulse and on the reference signal from the reference signal generating oscillator 99. The drive circuit 95 supplies drive power based on the drive signal to the DC motor 85 to drive the DC motor 85 at the same rotational speed as the DC motor 81.

With this configuration both the DC motors 81, 85 are maintained at a fixed rotational speed by the same reference signal generating oscillator 99, Therefore, the rotational speeds of the DC motors 81, 85 can be properly matched and the intermediate transfer belt 26 and the photosensitive belt 22 can be rotated at the same speed. Accordingly, the above-described problems of distorted image because of the contact and separation operations of the intermediate transfer belt cleaning unit 60 and color shifts in the multicolor image by positional shift during the primary transfer operations can be prevented.

Next, configuration and operation of a printer 101 according to a second embodiment of the present invention will be explained with reference to FIGS. 7 and 8. Components that are the same or similar to those in the first embodiment are assigned with the same numberings, and their explanation will be omitted to avoid duplication of explanation.

Figure 8:
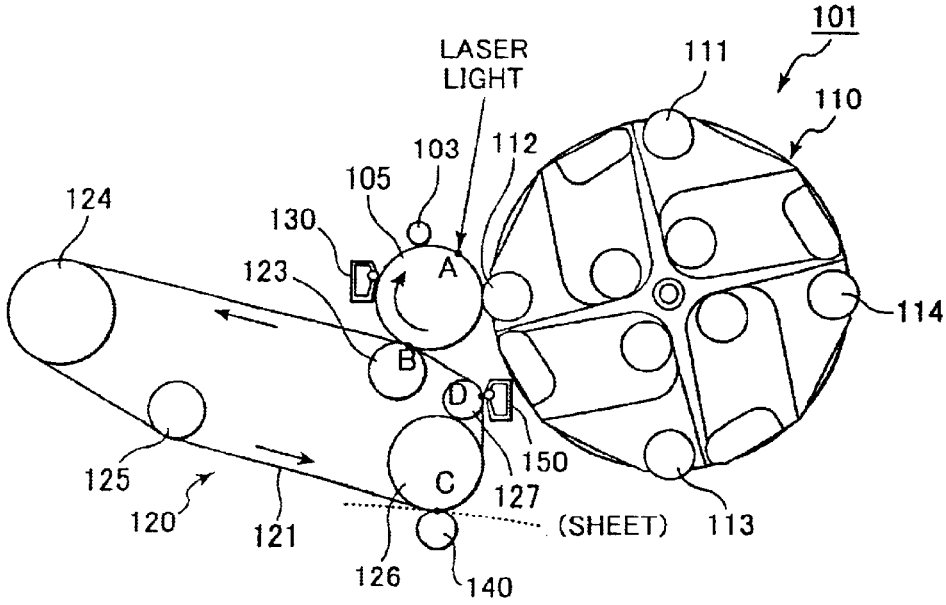
FIG. 8 is a cross-sectional view showing configuration of a printer according to a second embodiment of the present invention.

As shown in FIG. 8, the printer 101 includes a charge unit 103, a photosensitive drum 105, a developing unit 110, an intermediate transfer member mechanism 120, a photosensitive drum cleaning unit 130, and an intermediate transfer member cleaning unit 150.

The intermediate transfer member mechanism 120 includes an intermediate transfer belt 121 and a plurality of intermediate transfer belt rollers 123 to 127 for rotating the intermediate transfer belt 121 while supporting the intermediate transfer belt 121 from the inside. The photosensitive drum cleaning unit 130 has substantially the same configuration as the photosensitive belt cleaning unit 50 and the intermediate transfer member cleaning unit 150 has substantially the same configuration as the intermediate transfer belt cleaning unit 60. The photosensitive drum cleaning unit 130 is disposed downstream from the primary transfer point B in the rotational direction of the photosensitive drum 105. The charge unit 103 is disposed further downstream than the photosensitive drum cleaning unit 130.

The developing unit 110 is a rotating type developing unit that has a plurality of developing cartridges, that is, a cyan developing cartridge storing cyan toner, a magenta developing cartridge storing magenta toner, a yellow developing cartridge storing yellow toner, and a black developing cartridge storing black toner. One of four developing rollers 111 to 114 is provided to each of the developing cartridges.

When images are to be formed, first the photosensitive drum 105 is driven to rotate by a motor (not shown). Friction force between the photosensitive drum 105 and the intermediate transfer belt 121 rotates the intermediate transfer belt 121 in linked association with rotation of the photosensitive drum 105.

Also, the charge unit 103 charges the surface of the photosensitive drum 105 to a uniform charge, and the developing unit 110 rotates to bring the developing roller 112, which bears cyan toner, into contact with the photosensitive drum 105. An electrostatic latent image for cyan is formed at the exposure point A by using laser light. Rotation of the photosensitive drum 105 transports the electrostatic latent image to a position in confrontation with the developing roller 112, which develops the electrostatic latent image into a cyan color toner image. Further rotation of the photosensitive drum 105 transports the cyan toner image to the primary transfer point B, whereupon the cyan toner image is transferred onto the intermediate transfer belt 121 in a primary transfer operation. Afterward, rotational movement of the intermediate transfer belt 121 moves the toner image to the secondary transfer point C and the cleaning point D in this order and back to the primary transfer point B.

Before the cyan toner image reaches the primary transfer point B again, the photosensitive drum cleaning unit 130 removes all residual toner remaining from the primary transfer operation off the photosensitive drum 105.

Next, the charge unit 103 again charges the surface of the photosensitive drum 105. An electrostatic latent image for magenta color is formed at the exposure point A at timing that matches the rotation cycle T0 of the intermediate transfer belt 121. At timing that matches this, the developing unit 110 rotates until the developing roller 111, which bears magenta toner, abuts the photosensitive drum 105 to develop the electrostatic latent image into a magenta toner image on the surface of the photosensitive drum 105 as the electrostatic latent image passes by the developing roller 111.

Afterward, the magenta toner image is transferred on top of the cyan toner image at the primary transfer point B in a primary transfer operation. These operations are repeated for yellow and black to form a multicolor toner image by overlapping all four colors of toner image on the surface of the intermediate transfer belt 121.

As the multicolor toner image passes by the secondary transfer point C, the multicolor toner image is transferred onto the sheet 3 that passes between the transfer roller 140 and the intermediate transfer belt roller 126. Before the residual toner from the secondary transfer operation reaches the cleaning point D, the intermediate transfer member cleaning unit 150 is switched into a contact condition where the intermediate transfer member cleaning unit 150 abuts against the surface of the intermediate transfer belt 121 to start cleaning the surface of the intermediate transfer belt 121.

Because the printer 101 of the present embodiment uses the photosensitive drum 105, taking the size of the printer 101 into consideration, the distance d(AB) from the exposure point A to the primary transfer point B can only be made so long. For this reason, the distance d(AB) is shorter than the maximum-sized toner image that the printer 101 can form, that is, as determined by the maximum sized sheet that the printer 101 can print on.

To cope with this difference, the exposure point A, the primary transfer point B, and the cleaning point D are located at positions that fulfill the relationship explained below and latent image forming, primary transfer, and cleaning operations are performed at a predetermined timing to be described below. It should be noted that the following example will be explained assuming that the next-image movement time T3 and the no-image forming time T2 are equal to each other (T3=T2). Also, the no-image forming time T2 is equal to the rotation cycle T0 of the intermediate transfer belt 121 less the latent-image forming time T1 (T2=T0−T1).

Figure 9:
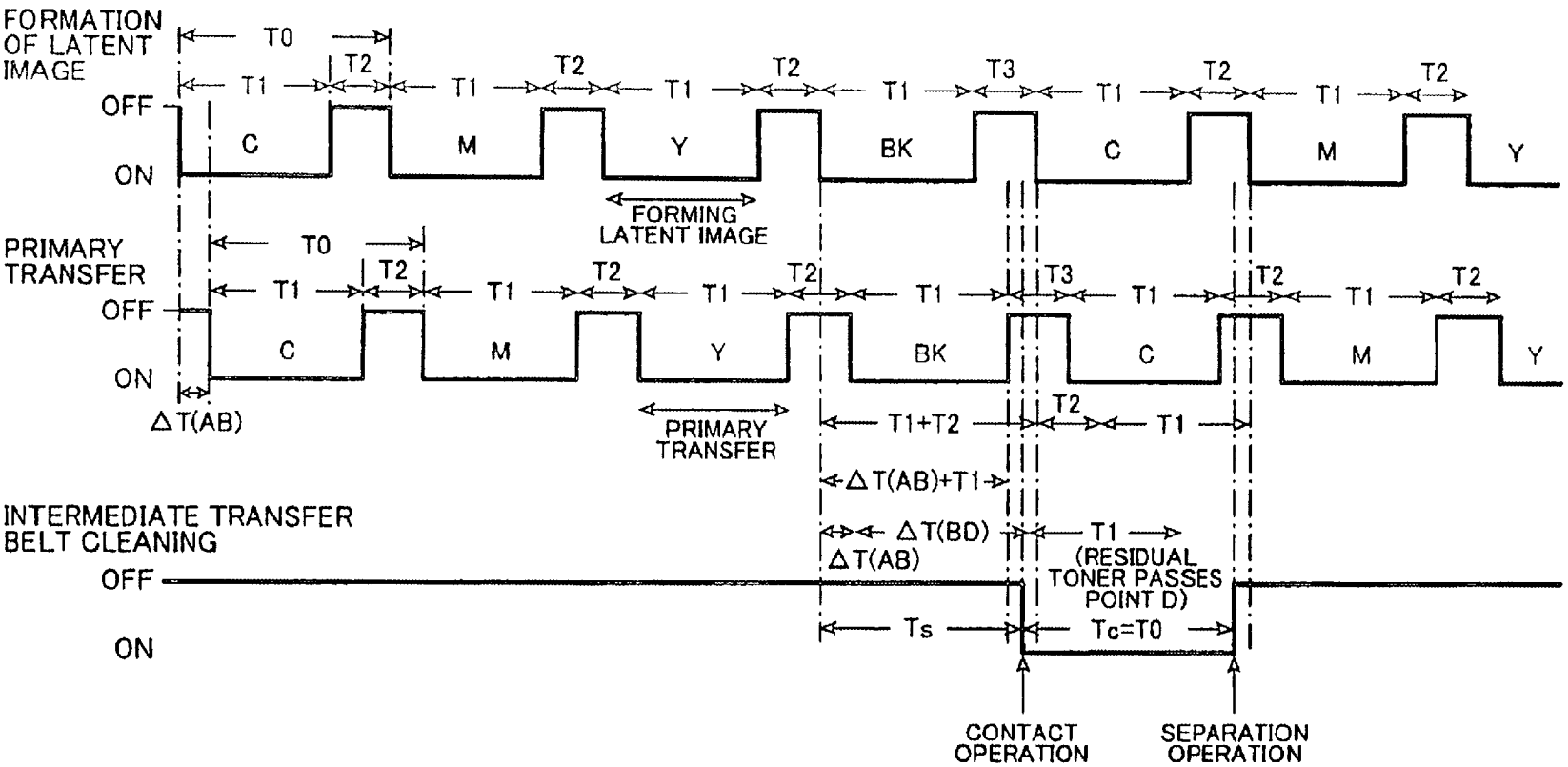
FIG. 9 is a time chart showing timing of switching operations of an intermediate transfer belt cleaning unit of the printer of FIG. 8.

As shown in FIG. 9, the primary transfer operation for the leading edge of the cyan toner image, for which latent image forming and development processes have been completed, starts while latent image forming operations are still being performed for later parts of the cyan toner image. That is, the fixed delay time ΔT(AB) is less than the latent-image forming time T1 (i.e., ΔT(AB)<T1). Therefore, in the present embodiment the primary transfer point B is set to a location so that the fixed delay time ΔT(AB) is less than the no-image forming time T2 (i.e., ΔT(AB)<T2). As a result, the primary transfer operation can be completed during a period wherein latent image forming is not being performed so that a period wherein neither latent image forming nor primary transfer operation is performed can be secured. It should be noted that the fixed delay time ΔT(AB) is the time required to move any particular point on the surface of the photosensitive drum 105 from the exposure point A to the primary transfer point B, and is calculated by a formula:

$$\Delta T(AB)=d(AB)/v)$$

wherein d(AB) is a moving distance of the photosensitive drum 105 from the exposure point A to the primary transfer point B; and v is the rotational speed of the photosensitive drum 105.

By switching the intermediate transfer member cleaning unit 150 between the contact and separation conditions during a period when neither latent image forming nor primary transfer operations are performed, shift and distortion during image formation can be prevented.

Further, the cleaning point D is located at a position to fulfill the following relationship:

$$T1<\Delta T(BD)<T0<T1+T2+T2-\Delta T(AB)$$

wherein ΔT(AB) is the time required for the toner image that was transferred in a primary transfer operation to the surface of the intermediate transfer belt 121 to reach the cleaning point D via the secondary transfer point C, and is calculated by a formula:

$$\Delta T(BD)=d(BD)/v$$

wherein d(BD) is a moving distance of the photosensitive drum 105 from the primary transfer point B to the cleaning point D; and v is the rotational speed of the intermediate transfer belt 121, which equals the rotational speed of the photosensitive drum 105.

This insures that only residual toner from a secondary transfer operation is removed from the intermediate transfer belt 121 without damaging a toner image that has not yet been transferred in a secondary transfer operation.

With this configuration, the intermediate transfer member cleaning unit 150 can be switched into the contact condition to clean the intermediate transfer belt 121 during a period wherein no latent image forming or primary transfer operation is being performed and before the leading edge of the multicolor toner image that was transferred in a secondary transfer operation reaches the cleaning point D. Further, the intermediate transfer member cleaning unit 150 can be switched into the separation condition during a period wherein no latent image forming or primary transfer operation is being performed, after the trailing edge of residual toner from a secondary transfer operation reaches the cleaning point D, and before a next cyan toner image reaches the cleaning point D. Therefore, image shift and distortion caused by the contact and separation operations of the intermediate transfer member cleaning unit 150 can be prevented.

It should be noted that in the second embodiment, the primary transfer point B is set to a position that fulfills the following relationship:

$$d(AB)<Lc-L1$$

wherein Lc is a total length around the periphery of the intermediate transfer belt 121; and L1 is a maximum length of the maximum-sized toner image that the printer 101 can form with respect to the peripheral direction of the photosensitive drum 105.

As a result, a period will exist wherein neither latent image forming nor primary transfer operations are performed. Also, the cleaning point D is set to a position that fulfills the following relationship:

$$L1<d(BD)$$

wherein d(BD) is a moving distance of the intermediate transfer belt 121 from the primary transfer point B to the cleaning point D.

As a result, the contact operation can be performed at a time when neither a latent image forming operation nor a primary transfer operation is being performed, and at the same time, residual toner from the secondary transfer operation can be removed without damaging toner images before they are transferred in a secondary transfer operation.

While the invention has been described in detail with reference to specific embodiments thereof, it would be apparent to those skilled in the art that various changes and modifications may be made therein without departing from the spirit of the invention, the scope of which is defined by the attached claims.

For example, in the same manner as the modification of the first embodiment, the printer 101 of the second embodiment can be provided with separate motors for driving the intermediate transfer belt 121 and the photosensitive drum 105 to rotate such that the intermediate transfer belt 121 and the photosensitive drum 105 do not slide against each other at the primary transfer point B.

Also, rotational shafts of the intermediate transfer belt 121 and the photosensitive drum 105 can be connected by gears so that the intermediate transfer belt 121 is rotated in linked association with rotation of the photosensitive drum 105 by rotational force transmitted by the gears.

When the gears are used in this manner, there will be no image distortion from the surfaces where the intermediate transfer belts 26, 121 contact the photosensitive belt 22 or the photosensitive drum 105 sliding against each other at the primary transfer point B. Therefore, the intermediate transfer belt cleaning unit 60 or the intermediate transfer member cleaning unit 150 can be switched into the contact or the separation condition without concern as to whether a primary transfer operation is being performed, as long as it is during a period wherein latent image forming operations are not being performed. Because contact and separation operations can be performed even if a primary transfer operation is being performed, the printer can be more freely designed with respect to location of the intermediate transfer belt cleaning unit 60 or the intermediate transfer member cleaning unit 150.

In more concrete terms, if the condition that contact and separation operations of the intermediate transfer member cleaning unit 150 can only be performed when no primary transfer operations are being performed is removed from the second embodiment, then in order to insure that contact and separation operations of the intermediate transfer member cleaning unit 150 are performed when no latent image forming operations are being performed, then the intermediate transfer member cleaning unit 150 merely needs to be located at a position that fulfills the following relationship:

$$T1<\Delta T(AB)+\Delta T(BD)<T0,$$

or in terms of distance:

$$L1<d(AB)+d(BD)<Lc.$$

Although the above embodiments described the relationship of the exposure point A, the primary transfer point B, and the cleaning point D when latent image forming operations and primary transfer operations are performed at the timings showing in the time chart of FIG. 4 and the time chart of FIG. 9, the present invention can be applied to image forming devices that perform latent image forming operations and primary transfer operations at other timings as well. In order to perform contact and separation operations of an image bearing member cleaning unit of such image forming devices at timing when neither latent image forming nor primary transfer operations are being performed while performing latent image forming operations at timing to match the rotation cycle T0 of an image bearing member, the exposure point A, the primary transfer point B, and the cleaning point D can be set at positions that fulfill the following relationship:

$$d(AB)<Lc-L1 \text{ and } d(BD)>L1$$

or at positions that fulfill the following relationship:

$$L1>d(AB) \text{ and } L1<d(BD) \text{ and } d(AB)+d(BD)>Lc+L1$$

wherein Lc is a total length around the periphery of the image bearing member; and L1 is a length of a maximum-sized image that the image forming device can form.

What is claimed is:

1. An image forming apparatus comprising:

an endless photosensitive member that moves in a first direction;

an exposure device that performs exposure operations for exposing the photosensitive member at an exposure position to form a latent image on the photosensitive member;

a developing device that develops the latent image into a developing-agent image on the photosensitive member at a developing position that is downstream from the exposure position in the first direction;

an endless image bearing member that contacts the photosensitive member at a primary transfer position that is downstream from the developing position in the first direction, the image bearing member moving in a second direction, wherein the developing-agent image is transferred from the photosensitive member onto the image bearing member at the primary transfer position in primary transfer operations;

a secondary transfer device that performs secondary transfer operations for transferring the developing-agent image from the image bearing member onto a recording medium at a secondary transfer position that is downstream from the primary transfer position in the second direction;

a cleaning device that is switched between a contact condition where the cleaning device is in contact with the image bearing member at a cleaning position and a separation condition where the cleaning device is separated from the image bearing member, the cleaning position being downstream from the secondary transfer position and upstream from the primary transfer position in the second direction, the cleaning device in the contact condition removing residual developing agent from the image bearing member after the secondary transfer operations; and a control device that switches the cleaning device between the contact condition and the separation condition during a stopped period where no latent image is being formed.

2. The image forming apparatus according to claim 1, wherein:

the cleaning position is located downstream in the second direction from a leading edge of the residual developing agent at start of the stopped period;

the control device switches the cleaning device from the separation condition into the contact condition during the stopped period after a rear edge of the developing-agent image transferred onto the image bearing member at the primary transfer position passes the cleaning position in the second direction and before the leading edge of the residual developing agent reaches the cleaning position in the first second; and the control device switches the cleaning device from the contact condition into the separation condition during the stopped period after a rear edge position of the residual developing agent passes the cleaning position in the second direction and before a leading edge of a subsequent developing-agent image reaches the cleaning position in the second direction.

3. The image forming apparatus according to claim 1, wherein the exposure position, the primary transfer position, and the cleaning position are located to fulfill the following relationship:

$$D1+D2>L1$$

wherein:

D1 is a movement distance of the photosensitive member from the exposure position to the primary transfer position in the first direction;

D2 is a movement distance of the image bearing member from the primary transfer position to the cleaning position in the second direction; and L1 is a length of a maximum-sized developing-agent image.

4. The image forming apparatus according to claim 1, wherein the control device switches the cleaning device between the contact condition and the separation condition during a rest period in the stopped period, wherein the rest period is a period wherein the developing-agent image is not being transferred at the primary transfer position.

5. The image forming apparatus according to claim 4, wherein the primary transfer position is located such that a primary transfer operation for transferring an developing-agent image, into which a latent image formed in exposure operations was developed, onto the image bearing member is one of started and completed during a period between the end of the exposure operations and the start of subsequent exposure operations.

6. The image forming apparatus according to claim 4, wherein:

the cleaning position is located downstream in the second direction from a leading edge of the residual developing agent at start of the stopped period; and the control device switches the cleaning device from the separation condition to the contact condition during the stopped period after a rear edge of the developing agent image passes the cleaning position in the second direction and before the leading edge position of the residual developing-agent passes the cleaning position in the second direction; and the control device switches the cleaning device from the contact condition to the separation condition during the stopped period after the rear edge position of the residual developing agent passes the cleaning position in the second direction and before a leading edge of a subsequent developing agent image reaches the cleaning position in the second direction.

7. The image forming apparatus according to claim 4, wherein the exposure position, the primary transfer position, and the cleaning position are located at positions that fulfill the following relationships:

$D1<Lc-L1$ and $D2>L1$, wherein

D1 is a movement distance of the photosensitive member from the exposure position to the primary transfer position in the first direction;

Lc is a total length around a periphery of the image bearing member;

L1 is a length of a maximum-sized developing agent image; and

D2 is a movement distance of the image bearing member from the primary transfer position to the cleaning position in the second direction.

8. The image forming apparatus according to claim 4, wherein the exposure position, the primary transfer position, and the cleaning position are located at positions that fulfill the following relationships:

$L1<D1$, $L1>D2$, and $D1+D2>Lc+L1$, wherein:

D1 is a movement distance of the photosensitive member from the exposure position to the primary transfer position in the first direction;

Lc is a total length around a periphery of the image bearing member;

L1 is a length of a maximum-sized developing agent image; and

D2 is a movement distance of the image bearing member from the primary transfer position to the cleaning position in the second direction.

9. The image forming apparatus according to claim 1, wherein the image bearing member rotates in linked association with rotation of the photosensitive member by a first friction force generated by contact with the photosensitive member at the primary transfer position.

10. The image forming apparatus according to claim 9, wherein the first friction force is larger than a second friction force generated between the cleaning device and the image bearing member at the cleaning position when the cleaning device is switched into the contact condition.

11. The image forming apparatus according to claim 1, further comprising a linking device that links the image bearing member to the photosensitive member, the linking device rotating the image bearing member linkingly with rotation of the photosensitive member.

12. The image forming apparatus according to claim 11, wherein the linking device is a gear.

13. The image forming apparatus according to claim 1, further comprising:

a photosensitive member driving device that drives the photosensitive member to rotate;

an image bearing member drive device that drives the image bearing member to rotate; and a reference signal source that controls both the photosensitive member drive device and the image bearing member drive device.

14. The image forming apparatus according to claim 1, further comprising a developing device that controls the exposure device and the developing device, wherein the developing device stores a plurality of different colored toners as the developing agent;

the control device controls the exposure device and the developing device to form toner images as the developing-agent images for each of the different colored toners on the photosensitive member in an overlapping manner at the primary transfer position, resulting in a multicolor image on the image bearing member, and further controls the secondary transfer device to transfer the multicolor image to the recording medium; and the cleaning device in the contact condition removes residual toner remaining on the image bearing member after the multicolor image is transferred from the image bearing member.

15. The image forming apparatus according to claim 1, wherein the control device switches the cleaning device between the contact condition and the separation condition during a stopped period where no latent image is being formed and no primary transfer is being performed.

16. A method for forming an image using an image forming apparatus, the method comprising:

moving an endless photosensitive member in a first direction;

exposing the photosensitive member at an exposure position to form a latent image on the photosensitive member;

developing the latent image into a developing-agent image on the photosensitive member at a developing position that is downstream from the exposure position in the first direction;

contacting the photosensitive member at a primary transfer position, that is downstream from the developing position in the first direction, with an endless image bearing member that moves in a second direction, wherein the developing-agent image is transferred from the photosensitive member onto the image bearing member at the primary transfer position in primary transfer operations;

transferring the developing-agent image from the image bearing member onto a recording medium at a secondary transfer position that is downstream from the primary transfer position in the second direction;

switching a cleaning device between a contact condition where the cleaning device is in contact with the image bearing member at a cleaning position and a separation condition where the cleaning device is separated from the image bearing member, the cleaning position being downstream from the secondary transfer position and upstream from the primary transfer position in the second direction, the cleaning device in the contact condition removing residual developing agent from the image bearing member after the secondary transfer operations; and controlling the cleaning device to switch between the contact condition and the separation condition during a stopped period where no latent image is being formed.

17. The method according to claim 16, wherein the cleaning device is controlled to switch between the contact condition and the separation condition during a stopped period where no latent image is being formed and no primary transfer is being performed.

* * * * *